US009346070B2

(12) United States Patent
Herre

(10) Patent No.: US 9,346,070 B2
(45) Date of Patent: May 24, 2016

(54) UNIVERSAL ATOMIZER AND ASSOCIATED OPERATING METHOD

(75) Inventor: Frank Herre, Oberriexingen (DE)

(73) Assignee: Durr Systems GmbH, Stuttgart (DE)

( * ) Notice: Subject to any disclaimer, the term of this patent is extended or adjusted under 35 U.S.C. 154(b) by 1311 days.

(21) Appl. No.: 12/514,863

(22) PCT Filed: Nov. 5, 2007

(86) PCT No.: PCT/EP2007/009581

§ 371 (c)(1),
(2), (4) Date: Dec. 21, 2009

(87) PCT Pub. No.: WO2008/058650

PCT Pub. Date: May 22, 2008

(65) Prior Publication Data

US 2010/0133353 A1 Jun. 3, 2010

(30) Foreign Application Priority Data

Nov. 15, 2006 (DE) ..... 10 2006 053 921

(51) Int. Cl.
*A62C 31/00* (2006.01)
*B05B 5/00* (2006.01)
*F23D 11/32* (2006.01)
(Continued)

(52) U.S. Cl.
CPC ..... *B05B 12/1409* (2013.01); *B05B 5/0407* (2013.01)

(58) Field of Classification Search
CPC B05B 12/1409; B05B 5/0407; B05B 5/1616; B05B 12/1481; B05B 12/14; B05B 12/149; B05B 5/1633; B05B 5/1625; B05B 5/1675; B05B 7/1404; B05B 7/1472; B05B 3/1057; B05B 5/04; B05B 12/1472; B05B 7/0815; B05B 5/1641; B05B 7/2486; B05B 7/2489; B05B 5/16; B05B 15/025
USPC ..... 118/690, 302, 326; 239/690, 691, 700, 239/1, 3, 112, 110, 690.1, 569, 574, 436, 239/443, 444
See application file for complete search history.

(56) References Cited

U.S. PATENT DOCUMENTS 4,380,321 A 4/1983 Culbertson et al.
4,785,760 A * 11/1988 Tholome ..... 118/323
(Continued)

FOREIGN PATENT DOCUMENTS

DE 3534269 4/1987
DE 4105116 A1 8/1992
(Continued)

OTHER PUBLICATIONS

Svedja, "Flexibilitat ist Trumpf" article Jahrg. 54 (2000)10, pp. 44-47.
(Continued)

*Primary Examiner* — Len Tran
*Assistant Examiner* — Steven M Cernoch
(74) *Attorney, Agent, or Firm* — Bejin Bieneman PLC

(57) ABSTRACT

An atomizer, painting machine, paint cabin, and method of operating an atomizer are disclosed. The atomizer includes a first paint inlet for a first paint system, and at least one additional second paint inlet for a second paint system. Each of the paint inlets are separated from each other, so that the atomizer may optionally apply one of the two different paint systems.

39 Claims, 5 Drawing Sheets

(51) Int. Cl.

| | |
|---|---|
| ***B05B 1/30*** | (2006.01) |
| ***B05B 15/02*** | (2006.01) |
| ***B05B 12/14*** | (2006.01) |
| *B05B 5/04* | (2006.01) |

(56) References Cited

U.S. PATENT DOCUMENTS

| | | | | |
|---|---|---|---|---|
| 5,058,812 | A | 10/1991 | Cox et al. | |
| 5,271,569 | A * | 12/1993 | Konieczynski et al. | 239/690 |
| 5,630,552 | A * | 5/1997 | Anfindsen et al. | 239/708 |
| 5,676,756 | A | 10/1997 | Murate et al. | |
| 5,772,125 | A * | 6/1998 | Ehinger et al. | 239/694 |
| 6,309,464 | B1 * | 10/2001 | Anfindsen | 118/668 |
| 6,589,342 | B2 * | 7/2003 | Attinoto et al. | 118/308 |
| 6,589,348 | B2 | 7/2003 | Ott | |
| 7,005,159 | B2 * | 2/2006 | Ciarelli et al. | 427/195 |
| 7,549,449 | B2 * | 6/2009 | Herre et al. | 141/91 |
| 7,793,676 | B2 * | 9/2010 | Albrecht et al. | 137/15.05 |
| 2005/0173018 | A1 * | 8/2005 | Herre et al. | 141/91 |

FOREIGN PATENT DOCUMENTS

| | | | |
|---|---|---|---|
| DE | 19860087 | A1 | 7/1999 |
| DE | 10157966 | A1 | 6/2003 |
| DE | 10342643 | A1 | 4/2005 |
| DE | 10358646 | A1 | 7/2005 |
| DE | 102004038017 | A1 | 3/2006 |
| EP | EP 1134027 | A2 | 9/2001 |
| EP | 1208915 | | 5/2002 |
| EP | 1634651 | | 3/2006 |
| EP | 1134027 | A3 | 7/2006 |
| GB | 2084048 | | 4/1982 |
| JP | S61178416 | A | 8/1986 |
| JP | 61178416 | | 11/1986 |
| JP | 07-323245 | A | 12/1995 |
| JP | 09-122543 | A | 5/1997 |
| JP | 10071348 | A | 3/1998 |
| WO | 2005044466 | A2 | 5/2005 |
| WO | WO-2006/113201 | A2 | 10/2006 |

OTHER PUBLICATIONS

Svedja, English Translation of article "Flexibilitat is Trumpf" entitled "Flexibility is Trump" Jahrg. 54 (2000)10, pp. 44-47.

Svejda, Pavel, "Flexibilitat ist Trumpf" article in MO Oct. 2000, pp. 44-47.

* cited by examiner

UNIVERSAL ATOMIZER AND ASSOCIATED OPERATING METHOD

CROSS-REFERENCE TO RELATED APPLICATIONS

This Application is a National Phase application claiming the benefit of International Application NO. PCT/EP2007/009581, filed on Nov. 5, 2007, which claims priority to German Patent Application No. DE 10 2006 053 921.4 filed on Nov. 15, 2006, which claims the complete disclosures of which are hereby incorporated by references in their entireties.

BACKGROUND

The present disclosure concerns an atomiser, particularly a rotary atomiser, and a corresponding operating method in accordance with the sub-claims.

In systems for painting motor vehicle body components, different paint systems are used as wet paints, firstly solvent-based paints and secondly water-based paints, which are more environmentally-friendly. Application of the different paint systems is by atomisers, which may be, for example, in the form of rotary atomisers, having both a paint pipe for feeding the wet paint in the desired colour and a flushing pipe to flush the pipe during pauses in operation or when a colour change takes place, the flushing agent being matched to the paint system in use. In isolated cases, such atomisers are also used to apply different paint systems (water-based and solvent-based paints), but this is associated with increased flushing complexity when changing between the different paint systems (increased flushing agent consumption and time, entailing a change in the cycle time, making the logistics more complicated), as chemical reactions may occur between the different paint systems leading to curing, thereby damaging the atomiser irreversibly. For example, a change in paint system entails a coagulation hazard, as some paints are incompatible, i.e. they may contaminate the common area used and, in the worst-case scenario, damage it. Curing tends to be an exception, constituting the "worst case scenario". Malfunctions in painting are inevitable due to the reaction between the incompatible systems. Consequently, mechanical cleaning may be necessary. This is not possible in every area in which paint is conveyed. Ultimately, this method is unsuitable for series production, due to the costs of loss of production. A third flushing agent is therefore frequently necessary when changing between different paint systems, to prevent the irritating chemical reaction between the different paint systems.

A painting system is known from DE 35 34 269 A1 in which two spray guns each have a single paint feed (paint pipe) supplying the paint to be applied. Complicated flushing processes are therefore necessary when changing between different paint systems (e.g. water-based paint/solvent-based paint).

The application device in the coating apparatus in accordance with WO 2005/044466 A2, DE 10 2004 038 017 A1 and DE 198 60 087 A1 also has only one paint feed system, making complicated flushing processes necessary between different paint systems (e.g. water-based paint/solvent-based paint).

An arrangement of valves for mixing the various components (e.g. master batch/hardener) of a multi-component paint is also known from DE 103 58 646 A1. However, the structure of this known valve arrangement renders it unsuitable for feeding different paint systems (e.g. water-based paint/solvent-based paint).

Reference should also be made to SVEJDA, Pavel: "Flexibilität ist Trumpf" ["Versatility comes up trumps"], Carl Hanser Verlag, Munich, Mo., vol. 54 (2000) 10, p. 44 et seq, DE 41 05 116 A1, DE 103 42 643 A1 and DE 101 57 966 A1.

Accordingly, there is a need in the art for a single application device that can employ multiple different painting systems, e.g., a water-based paint system and a solvent-based paint system, while generally preventing the malfunctions common in the above systems.

BRIEF DESCRIPTION OF THE DRAWINGS

Other advantageous exemplary illustrations are explained below in conjunction with the drawings.

DETAILED DESCRIPTION

Figure 1:
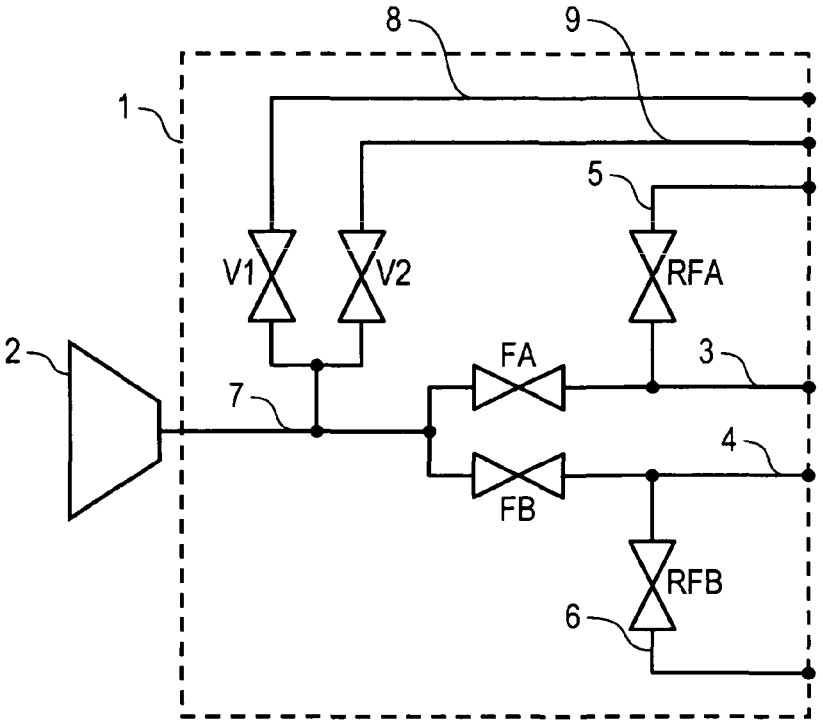
FIG. 1 is a diagrammatic representation of an exemplary rotary atomiser with several paint inlets for different paint systems and separate main needle vales for the individual paint systems.

Reference in the specification to "an exemplary illustration", an "example" or similar language means that a particular feature, structure, or characteristic described in connection with the exemplary approach is included in at least one illustration. The appearances of the phrase "in an illustration" or similar type language in various places in the specification are not necessarily all referring to the same illustration or example.

The exemplary illustrations disclosed herein are therefore based upon the problem of appropriately improving the known atomisers described above and specifying an associated method of operation.

This problem is solved by an exemplary atomiser and an associated operating method as described hereinbelow.

An exemplary illustration comprises the general technical teaching of providing separate paint feeds for the different paint systems in the atomiser, so that the atomiser can be operated with the different paint systems alternately.

The distinction made between different paint systems within the scope of the exemplary illustrations preferably distinguishes between solvent-based paints on one hand and water-based paints on the other hand, whereby both paint systems can be supplied with different colours. Water-based paints of different colours therefore belong to the same paint system within the meaning of the exemplary illustrations, just as solvent-based paints of different colours are to be allocated to the same paint system. The concept of a paint system used within the scope of the various exemplary illustrations therefore includes all the components of the respective paint, such as solvents, binders, additives, pigments and fillers. The different paint systems may therefore be distinguished within the scope of the exemplary illustrations, for example by the solvent used, as aforementioned, where one paint system may contain mainly water as a solvent, while the other paint system may contain an organic solvent.

Furthermore, the various paint systems may also be used to apply different layers of paint within the scope of the exemplary illustrations. For example, a water-based primer may be applied, followed by a water-based base coat and subsequently a solvent-based clear varnish.

In one exemplary illustration, the different paint inlets for the individual paint systems each have separate main needle valves which supply a common application device (e.g. a bell cup) with the different paint systems.

The term "application device" used herein generally refers to rotating bell cups, which are known and therefore require no further description. However, the exemplary illustrations are not restricted to bell cups in respect of the application device, but also includes, for example, the discs usual in disc atomisers, baffle plates, air atomisers, etc.

Separate main needle watchdogs are preferably also provided in the aforementioned exemplary illustration with separate main needle valves, to monitor and/or set the valve position of the individual main needle valves independently of each other.

In contrast, a common main needle valve is provided for the different paint inlets in another exemplary illustration. In this case, the individual paint inlets for the different paint systems are therefore combined in the atomiser and then discharge into the common main needle valve, which is located upstream of the application device (e.g. a bell cup).

In this example with a common main needle valve, an isolating valve is preferably provided in each individual separate paint inlet upstream of the main needle valve, so that the individual paint inlets can be isolated independently of each other. This is important in order to prevent a chemical reaction between the different paint systems when changing between chemically-incompatible paint systems (e.g. water-based paint and solvent-based paint).

Furthermore, an exemplary atomiser may advantageously have separate return pipes for the individual paint inlets, facilitating rapid flushing with high flushing agent currents or volumes in each paint inlet. The potential flushing agent currents are restricted when flushing through the bell cup, as the bell cup can be flooded. All the "waste" material from the cabin and elution must also be filtered out of the elution. In contrast, return lines are usually connected directly to appropriate sumps, which simplifies disposal considerably. Furthermore, the return lines facilitate constant circulation of the respective paint system. A further important point for the use of return pipes in the different areas is the time saved by at least partial parallel processes, e.g. flushing between the colour changer and atomiser (depending upon the type of charging and paint).

Such return pipes may be completely separated from each other in the atomiser, thereby preventing a chemical reaction between incompatible paint systems. However, when chemically compatible paint systems are used, the possibility also exists for the individual return pipes for the different paint systems to discharge into a common return pipe downstream.

An exemplary atomiser may also have an electrostatic charge for the wet paint applied. External and/or direct charging may be used optionally, which is known from prior art. An exemplary atomiser may therefore have at least one external electrode for external electrostatic charging of the paint systems applied and/or at least one contact electrode for direct electrostatic charging of the paint system applied.

Furthermore, combined charging, where both direct and external charging take place, is possible in connection with the various exemplary illustrations. Such combined charging is described, for example in patent application DE 41 05 116 A1, which is hereby expressly incorporated by reference in its entirety, so the content of this patent application is to be attributed to the existing description to its full extent. For example, the water-based and solvent-based paint systems may be charged directly. Alternatively, the possibility exists within the scope of the exemplary illustrations that water-based paint only be charged by external charging while solvent-based paint is charged by combined charging. The possibility also exists for external charging to be electrically grounded when applying solvent-based paint, to prevent ignition of the solvent-based paint by a flying spark. The external charging system and its appurtenant electrodes can also be temporarily removed from the atomiser and stored when applying solvent-based paint, as described, for example, in patent application EP 1 634 651 A1, so the content of the latter must be attributed to this description in full.

An exemplary atomiser may advantageously have separate flushing pipes for the individual paint systems, to facilitate the feed of chemically-compatible flushing agents matched to the respective paint system.

In this case a flushing pipe may be allocated to each paint inlet, to facilitate feeding the respective matched flushing agent for the respective paint system (water-based paint or solvent-based paint).

In one exemplary illustration, an additional flushing pipe is also provided, to prevent a chemical reaction between the different paint systems when changing between them. The additional flushing agent must therefore be chemically compatible with the different paint systems and appurtenant flushing agents, working as a quasi-buffer.

In this example, the number of different flushing agents and thus usually the number of flushing pipes is greater than the number of different paint systems or paint inlets. For example, the number of different flushing agents or flushing pipes may be one more than the number of different paint systems or paint inlets.

In another exemplary illustration, the flushing pipes discharge into a section of pipe in the atomiser located downstream behind the common main needle valve or downstream behind the individual main needle valves. Such an arrangement of the flushing pipes is particularly suitable for short flushing of the application device, to clean the application device.

However, the possibility also exists for the flushing pipes to discharge into a section of pipe located upstream of the common main needle valve or before the separate main needle valves. The flushing pipe arrangement also advantageously facilitates flushing of the main needle valve or main needle valves.

In a combination of both these versions, at least one of the flushing pipes for short flushing may discharge into a pipe section in the atomiser located downstream behind the common main needle valve or behind the separate main needle valves, while at least one of the flushing pipes in the atomiser discharges into a section of pipe located upstream in front of the common main needle valve or separate main needle valves. For short flushing, a flushing agent is fed through the flushing pipe which discharges downstream behind the main needle valve or main needle valves, while the flushing pipe which discharges in front of the main needle valve or main needle vales is used for normal flushing processes.

In a further exemplary illustrations, the atomiser has two main needle valves, through each of which one paint system (e.g. water-based paint or solvent-based paint) may be fed. However, only one flushing pipe is provided in this example, discharging into a section of pipe downstream, behind both the main needle valves.

The present disclosure envisions not only the atomiser described above in the form of a single component, but also a complete painting machine with such an atomiser, where the painting machine may be in the form of a multiple-axis painting robot, side painting machine or roof machine. However, the exemplary illustrations are not restricted in application merely to painting robots, roof machines or side painting machines, but also may be utilized with any other known machines.

Flushing the atomiser with flushing agents for the different paint systems can then take place though several internal flushing pipes extending into the atomiser, as has already been described above.

However, the alternative possibility also exists of only one single internal flushing pipe being located in the atomiser, supplied from an arrangement of flushing valves outside the atomiser and from several external flushing pipes with different flushing agents for the individual paint systems.

In an exemplary illustration, the atomiser has two internal flushing pipes, one of the two internal flushing pipes being used for short flushing and therefore discharging into a section of pipe downstream behind the main needle valve, while the other internal flushing pipe discharges into a section of pipe upstream before the main needle valve. Both the internal flushing pipes in the atomiser are then supplied with different flushing agents for the individual paint systems by the flushing valve arrangement from several (e.g. three) external flushing pipes. In general, the possibility therefore exists for the number of external flushing pipes to be greater than the number of internal flushing pipes, where the flushing valve arrangement optionally connects the external flushing pipes to the internal flushing pipes.

In a painting robot with several robot arms, the external flushing valve arrangement may, for example, be located on "arm 1" or "arm 2" of the painting robot. However, the exemplary illustrations are not restricted to the above examples in respect of the spatial arrangement of the flushing valve arrangement, but may also be implemented in another way.

An exemplary painting machine may have separate supply lines for the different paint systems.

The individual supply lines for the different paint systems may each have a colour changer, to facilitate a colour change in each supply line.

Furthermore, metering of the different paint systems may take place by means of separate metering pumps located in the individual supply lines.

An exemplary painting machine may be a multiple-axis painting robot that includes a first robot arm ("arm 1") and a second robot arm ("arm 2"), where the second robot arm is movably articulated to the first robot arm and has a direct robot wrist with an application device (e.g. a rotary atomiser). Both the metering pumps for the different paint systems may be fitted on or in the first robot arm ("arm 1"), for example. There is an alternative possibility that individual metering pumps for the different paint systems to be fitted on or in the second robot arm ("arm 2"). There is also a possibility that one of the metering pumps be fitted on or in the first robot arm, while the second of the two metering pumps be fitted to the second robot arm.

For example, an exemplary painting machine may have an axis of travel with a carriage moveable along a rail, where the carriage bears a painting robot, for example. The metering pumps may then be wholly or partly arranged to travel on the carriage.

There is also the possibility that the individual metering pumps are wholly or partly integrated into the atomiser.

However, the present disclosure is not restricted to the above examples in respect of the spatial arrangement of the metering pumps, but may also be implemented in another way.

The exemplary illustrations also include a paint cabin with an exemplary painting machine as described above and a cabin wall which spatially restricts the paint cabin. The metering pumps for the individual paint systems may be located wholly or partly on the cabin wall, either inside the paint cabin or outside the paint cabin.

Finally, the exemplary illustrations also include an operating method for an atomiser, to facilitate universal operation with different paint systems.

Turning now to FIG. 1, a rotary atomiser 1 is illustrated with a bell cup 2 borne so that it will rotate, where the rotary atomiser 1 is used to apply both a solvent-based paint and a water-based paint.

The water-based paint is fed through a paint inlet 3, while the solvent-based paint is fed through a separate paint inlet 4 in the rotary atomiser 1.

A return pipe 5, 6 diverges from both paint inlets 3, 4 for water-based paint and solvent-based paint, so that both paint systems can circulate constantly in the paint inlets.

Advantageously, the paint inlet 3 and the appurtenant return pipe 5 on one hand and the other paint inlet 4 and the appurtenant return pipe 6 on the other hand be separate from each other, to prevent contact between the different paint systems (solvent-based paint and water-based paint). This advantageously prevents contact between the different paint systems that would otherwise lead to a chemical reaction and irreversible damage to the rotary atomiser 1.

An isolating valve RFA or RFB is also located in both return pipes, to allow return pipes 5 and 6 to be sealed off.

For example, the isolating valve RFA is closed when the main needle valve FA is opened, as no circulation through the return pipe 5 is then necessary. Conversely, isolating valve RFA is opened when the main needle valve FA is closed, so that the paint system in paint inlet 3 can then circulate through the return pipe 5.

In the same way, the isolating valve RFB in return pipe 6 is opened when the other main needle valve FB is closed. Conversely, the isolating valve RFB is closed when the main needle valve FB is opened, as no circulation through the return pipe 6 is then necessary.

Both paint inlets 3, 4 discharge through a respective main needle valve FA or FB into a common section of pipe 7, which leads to the bell cup 2.

Furthermore, the rotary atomiser 1 has two flushing lines 8, 9 which extend separately in the rotary atomiser 1, whereby a flushing agent for solvent-based paint is introduced through the flushing pipe 8 while a flushing agent for water-based paint is introduced through the flushing pipe 9.

The two flushing pipes 8, 9 each discharge through a flushing valve V1 or V2 into the section of pipe 7 between the two main needle valves FA, FB and the bell cup 2, thereby facilitating flushing of the rotary atomiser 1 with the various flushing agents, which are fed through both the flushing pipes 8, 9.

Figure 2:
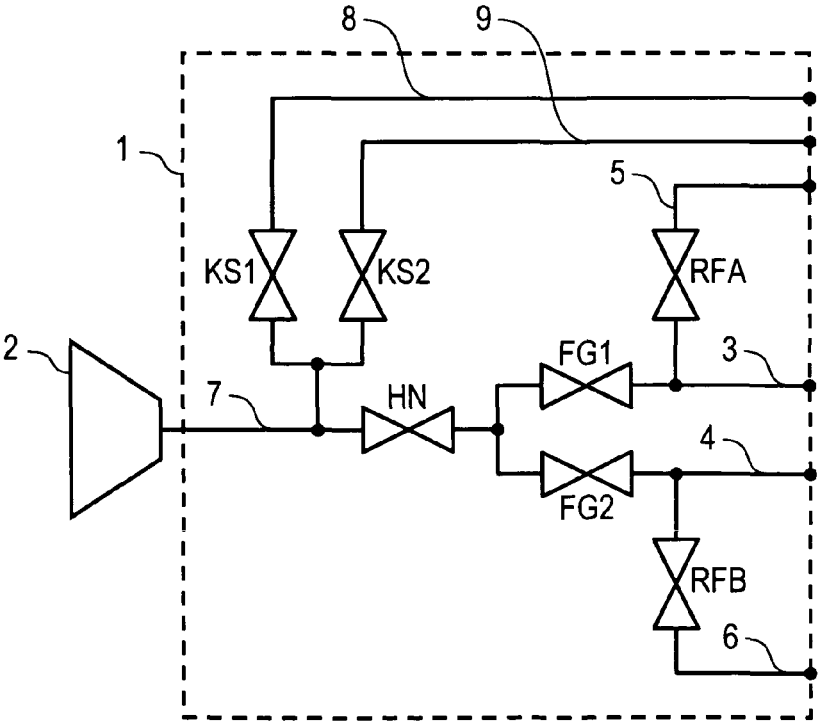
FIG. 2 is a modification of the exemplary illustration of FIG. 1 with a common main needle valve for the different paint inlets.

The exemplary illustration in FIG. 2 largely matches the exemplary illustration in FIG. 1, so reference is made to the above description to avoid repetition, whereby the same reference numbers are used for the corresponding details below.

A peculiarity of this example is that a common main needle valve HN is located in the section of pipe 7, while an isolating valve FG1 and FG2 is located in the two paint inlets 3, 4, to prevent contact between the different paint systems in the two paint inlets 3, 4.

Figure 3:
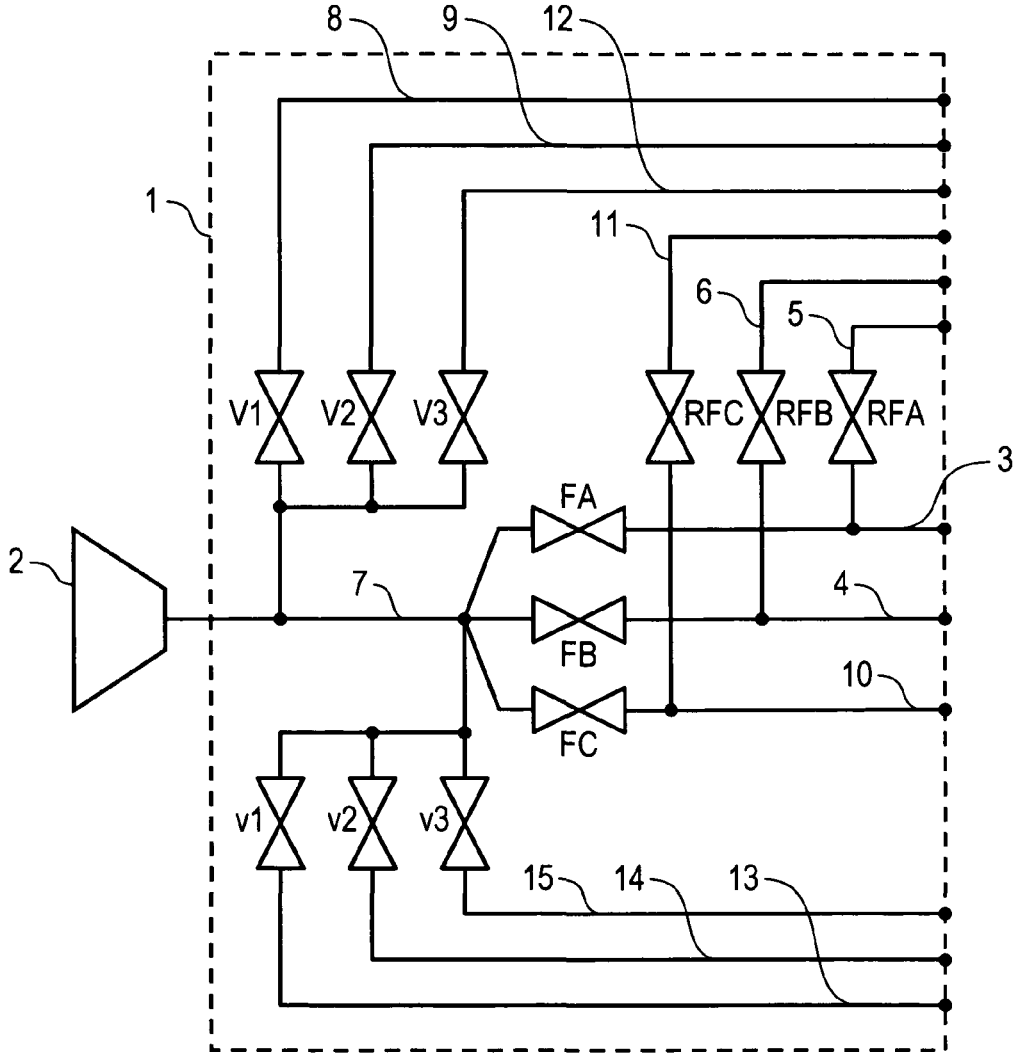
FIG. 3 is a modification of the exemplary illustration shown in FIG. 1 with three paint inlets, three flushing pipes for short flushing and three normal flushing pipes.

The exemplary illustration in FIG. 3 largely matches the exemplary illustration in FIG. 1, so reference is made to the above description to avoid repetition, whereby the same reference numbers are used for the corresponding details below.

A peculiarity of this example is that a third paint inlet 10 is provided as well as the two paint inlets 3, 4, which discharges into the common section of pipe 7 through a further main needle valve FC.

Furthermore, a separate return pipe 11 diverges from the third paint inlet 10 through an isolating valve RFC, so that the paint introduced can also circulate constantly in the paint inlet 10, as has already been described above.

A further peculiarity of this exemplary illustration is that, in addition to the two flushing pipes 8, 9, a third flushing pipe 12 discharges into the section of pipe 7 through a further flushing valve V3, whereby the discharge point of the flushing pipes 8, 9 and 12 in this example are located immediately before the bell cup 2, so that the flushing pipes 8, 9, 12 are particularly suitable for short flushing of the bell cup 2.

The rotary atomiser 1 in this exemplary illustration also has three further flushing pipes 13, 14 and 15 which discharge into the common section of pipe 7 of the rotary atomiser 1 through a dedicated flushing valve V1, V2, V3. The discharge point of the flushing pipe 13-15 is then located in the common section of pipe 7, immediately behind the main needle valves FA-FC, i.e. at the upstream end of the common section of pipe 7. The flushing pipes 13-15 are therefore also suitable for normal flushing of the common section of pipe 7, which can be flushed less effectively by the flushing pipes 8, 9 and 12.

In this exemplary illustration, the rotary atomiser 1 not only facilitates a change between different paint systems (solvent-based paint and water-based paint), but also a change between different colours. In A/B mode, different paints from a paint system can this be introduced through both paint inlets 3, 4, while another paint system is fed though paint inlet 10.

Figure 4:
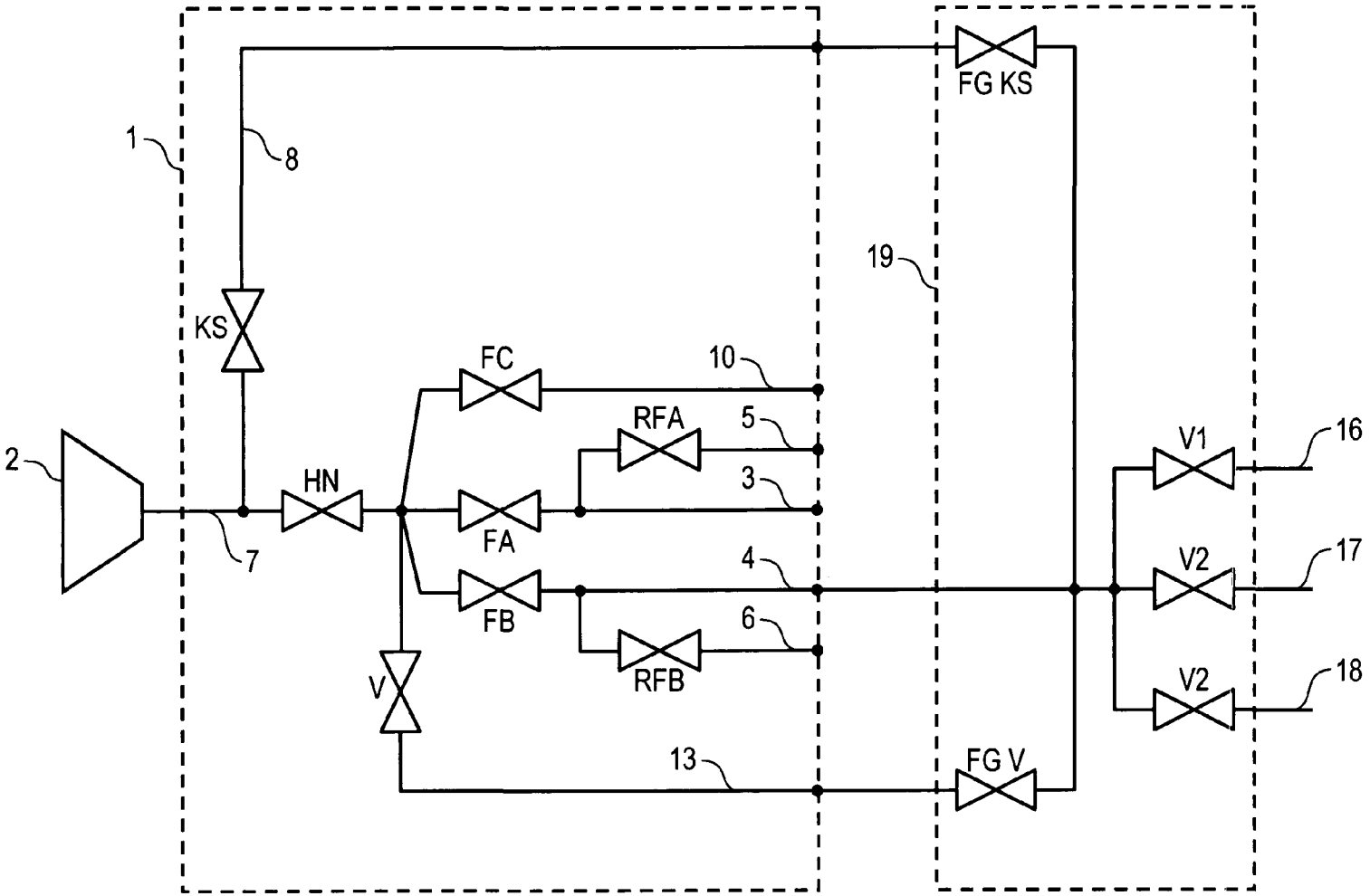
FIG. 4 is a further exemplary illustration of an atomiser with two internal flushing pipes in the atomiser and three external flushing pipes outside the atomiser, where the external flushing pipes feed the internal flushing pipes in the atomiser through a flushing valve arrangement.

FIG. 4 shows a modification of the exemplary illustration described above, so reference is made to the above description to avoid repetition, whereby the same numbers are used below for corresponding components.

A peculiarity of this example is that the rotary atomiser 1 has three paint inlets 3, 4 and 10, but only two internal flushing pipes 8, 13 for the introduction of different flushing agents.

The flushing pipe 8 then discharges through a downstream flushing valve KS behind the common main needle valve HN into the common section of pipe 7, so that the flushing pipe 8 is particularly suitable for short flushing of the bell cup 2.

In contrast, the other flushing pipe 13 discharges through a flushing valve V into the downstream common section of pipe 7 before the common main needle valve H. The flushing pipe 13 is therefore also suitable for flushing the main needle valve HN.

Different flushing agents matched to the different paint systems can also be introduced in this exemplary illustration and fed through three external flushing pipes 16, 17, 18. The external flushing pipes 16, 17, 18 are then connected to both internal flushing pipes 8, 13 though an external flushing valve arrangement 19, so that each of the external flushing pipes 16-18 can be connected to one or both of the flushing pipes 8, 13 by the flushing valve arrangement 19.

The flushing valve arrangement 19 is then located outside the rotary atomiser 1 and may, for example, be located on a robot arm of a painting robot. The distribution of the various flushing agents by the external flushing pipes 16-18 to both internal flushing pipes 8, 13 takes place through three flushing valves V1, V2 and V3 in a parallel circuit and two flushing valves FG KS and GF V in a parallel circuit on the outlet side.

Figure 5:
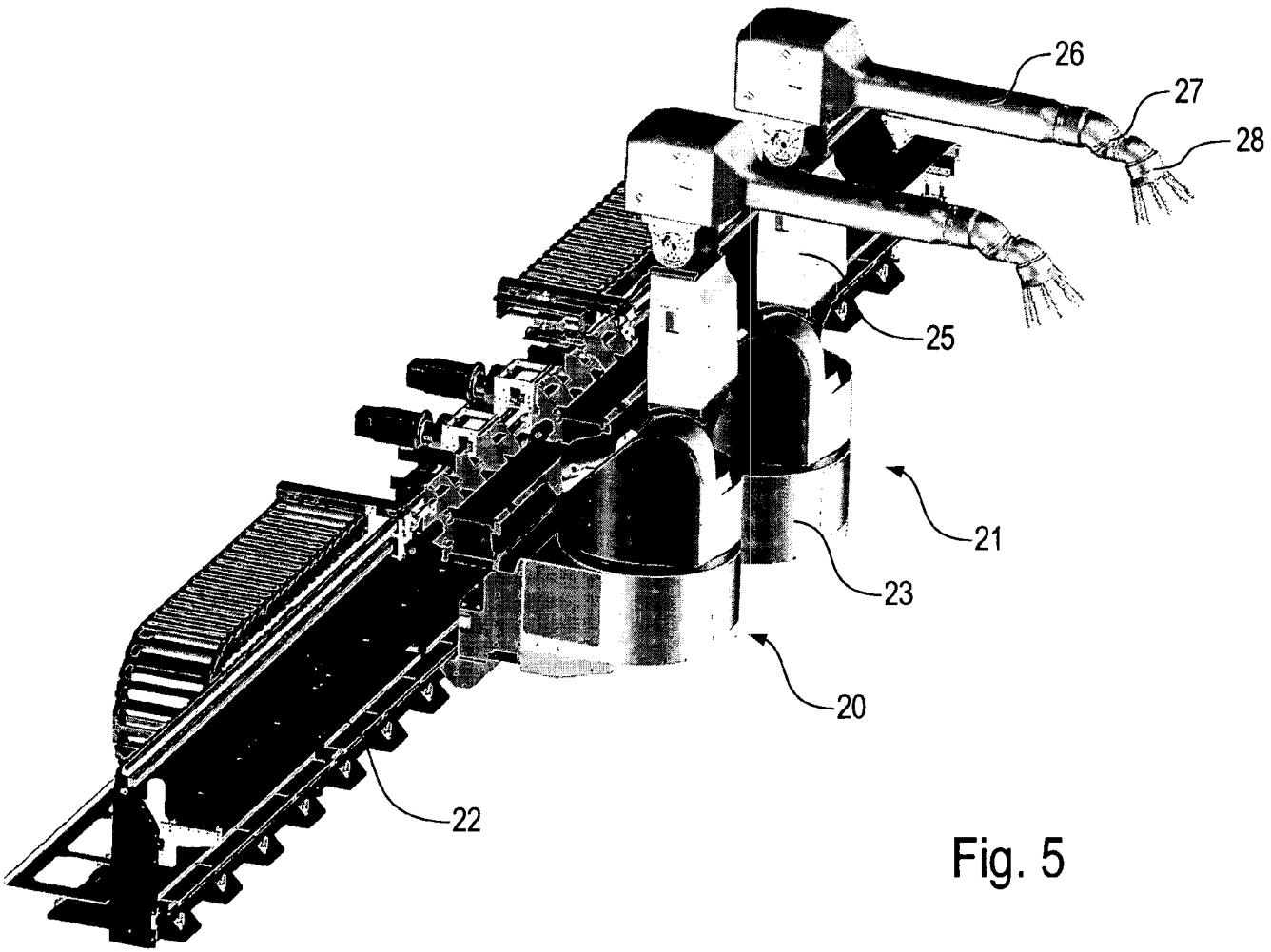
FIG. 5 is a three-quarter view of exemplary painting robots.

Finally, FIG. 5 shows two exemplary painting robots 20, 21, which can be moved linearly along a traversing rail 22.

Both painting robots 20, 21 each have a robot base 23 on which a turret 24 is mounted so that it will rotate about a vertical axis. A robot arm 25 ("arm 1") is pivoted on the turret 24 and bears a further robot arm 26 ("arm 2"). The robot arm 26 finally bears an electrostatic rotary atomiser 28, as described above and as shown in various exemplary illustrations in FIGS. 1 to 4, on a robot wrist 27.

Various components of the painting system, such as the meter, colour changer and the flushing valve arrangement 19 in FIG. 4, can be distributed and located in the robot base 23, the turret 24 and both the robot arms 25, 26.

Figure 6:
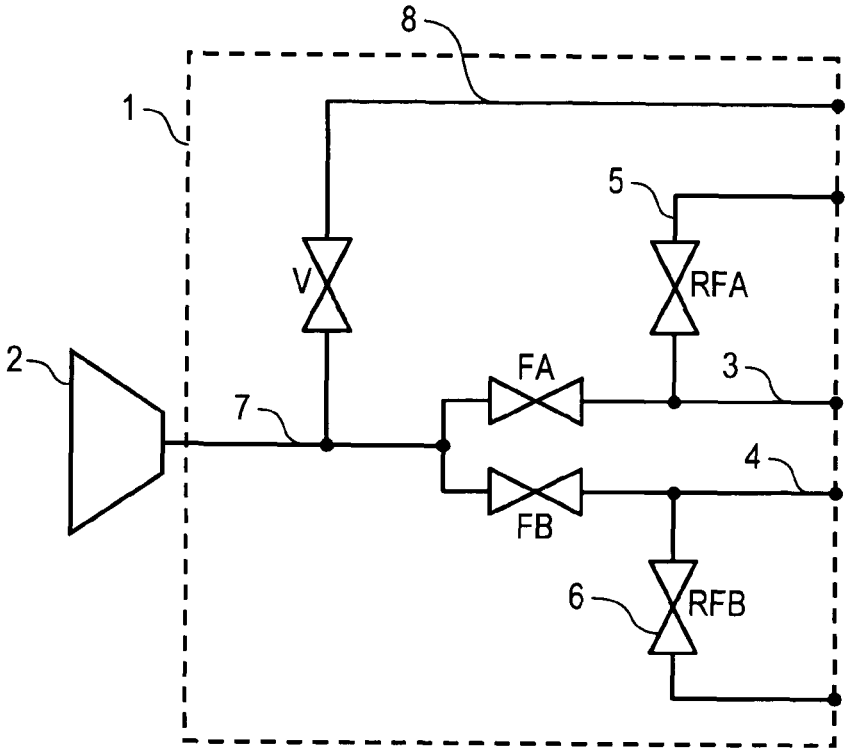
FIG. 6 is a modification of the exemplary illustrations shown in FIG. 1.

The exemplary illustration in FIG. 6 largely matches the example shown in FIG. 1, so reference is made to the above description to avoid repetition, the same reference numbers being used for the corresponding details below.

A peculiarity of this exemplary illustration is that the flushing pipe 8 is the only flushing pipe.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain approaches, examples or embodiments, and should in no way be construed so as to limit the claimed invention.

Accordingly, it is to be understood that the above description is intended to be illustrative and not restrictive. Many examples and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future examples. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

The invention claimed is:

1. An atomizer comprising:

a first paint inlet for a first paint system;

at least one additional second paint inlet for a second paint system;

an application device for applying both the paint systems;

a common inlet extending between the application device and each of the first paint inlet and the at least one additional second paint inlet;

a first main needle valve between the first paint inlet and the common inlet;

a second main needle valve between the at least one additional second paint inlet and the common inlet, each of the first paint inlet and the at least one additional second paint inlet being fluidly coupled to the application device through the first and second main needle valves, respectively, and the common inlet;

a first flushing pipe fluidly coupled to the common inlet for flushing the atomizer with a first flushing agent matched to the first paint system, and a second flushing pipe fluidly coupled to the common inlet for flushing the atomizer with a second flushing agent matched to the second paint system, and wherein at least one of the first and second flushing pipes is coupled to a section of pipe upstream of the first and second main needle valves, wherein the first and second flushing pipes are each fluidly coupled to the common inlet downstream of the first paint inlet and the at least one additional second paint inlet, the first and second flushing pipes extending separately from each other in the atomizer and facilitating the introduction of different flushing agents for both paint systems, wherein both the first and the at least one additional second paint inlets are separated from each other upstream of the common inlet, so that the atomizer may optionally apply one of the two different paint systems.

2. The atomizer according to claim 1, wherein the atomizer is a rotary atomizer.

3. The atomizer according to claim 1, wherein the application device is a bell cup.

4. The atomizer according to claim 1, further comprising:

a first needle valve watchdog for monitoring the first main needle valve; and an additional second needle valve watchdog for monitoring the second main needle valve.

5. The atomizer according to claim 1, further comprising:

a common main needle valve in the common inlet, wherein the common main needle valve is fluidly connected to the application device through the common inlet and supplies the application device with one of the first and second paint system.

6. The atomizer according to claim 5, wherein the application device is a bell cup.

7. The atomizer according to claim 1, further comprising:

a first return pipe which diverges from the first paint inlet; and a second return pipe which diverges from the second paint inlet, where the return pipes are separate from each other.

8. The atomizer according to claim 7, wherein both the separate return pipes discharge into a common return pipe downstream.

9. The atomizer according to claim 1, further comprising at least one external electrode for external electrostatic charging of the paint systems applied.

10. The atomizer according to claim 1, further comprising at least one contact electrode for direct electrostatic charging of the paint systems applied.

11. The atomizer according to claim 1, further comprising a third flushing pipe fluidly coupled to the common inlet downstream of the first paint inlet and the at least one additional second paint inlet for flushing the atomizer with a third flushing agent, which prevents a chemical reaction between the paint systems and between the matched flushing agents when the paint systems are changed.

12. The atomizer according to claim 1, wherein the different paint systems comprise a water-based paint and a solvent-based paint.

13. The atomizer according to claim 1, wherein the different paint systems comprise a base coat and a clear varnish.

14. A painting machine, comprising:

an atomizer with a first paint inlet for a first paint system;

at least one additional second paint inlet for a second paint system;

an application device for applying both the paint systems;

a common inlet extending between the application device and each of the first paint inlet and the at least one additional second paint inlet;

a first main needle valve between the first paint inlet and the common inlet;

a second main needle valve between the at least one additional second paint inlet and the common inlet, each of the first paint inlet and the at least one additional second paint inlet being fluidly coupled to the application device through the first and second main needle valves, respectively, and the common inlet;

at least one first internal flushing pipe fluidly coupled to the common inlet downstream of the first paint inlet and the at least one additional second paint inlet, the at least one internal flushing pipe being separated from the first paint inlet and the at least one additional second paint inlet upstream of the common inlet, and at least one second internal flushing pipe in the atomizer fluidly coupled to a section of pipe upstream of the first and second main needle valves of the atomizer, wherein both the first and the at least one additional second paint inlets are separated from each other upstream of the common inlet, so that the atomizer may optionally apply one of the two different paint systems.

15. The painting machine according to claim 14, wherein the painting machine is a painting robot.

16. The painting machine according to claim 14, further comprising:

a plurality of external flushing pipes, which are located outside the atomizer and each introduce a flushing agent for one of the paint systems, and a flushing valve arrangement located outside the atomizer, which is connected to the plurality of external flushing pipes on the inlet side and with the at least one internal flushing pipe on the inlet side.

17. The painting machine according to claim 14, further comprising:

a first supply line which supplies the first paint inlet of the atomizer with the first paint system, and a second supply line which supplies the second paint inlet of the atomizer with the second paint system, where both supply lines are separate from each other.

18. The painting machine according to claim 17, further comprising:

a first colour changer, which feeds an interchangeable colour from the first paint system to the first supply line; and a second colour changer, which feeds an interchangeable colour from the second paint system to the second supply line.

19. The painting machine according to claim 14, further comprising:

a first metering pump for metering the first paint system, and a second metering pump for metering the second paint system.

20. The painting machine according to claim 19, wherein,
the first metering pump is located in the first supply line, and
the second metering pump is located in the second supply line.

21. The painting machine according to claim 15, further comprising:
a first robot arm, and
a second robot arm which is articulated to the first robot arm and bears a robot wrist with the atomizer.

22. The painting machine according to claim 21, further comprising:
a first metering pump for metering the first paint system; and
a second metering pump for metering the second paint system,
wherein both of the metering pumps are located on the first robot arm.

23. The painting machine according to claim 21, further comprising:
a first metering pump for metering the first paint system; and
a second metering pump for metering the second paint system,
wherein both of the metering pumps are located on the second robot arm.

24. The painting machine according to claim 21, further comprising:
a first metering pump for metering the first paint system; and
a second metering pump for metering the second paint system,
wherein one of the two metering pumps is fitted to the first robot arm, while the other of the two metering pumps is fitted to the second robot arm.

25. The painting machine according to claim 19, further comprising a traversing rail with a carriage moveable on a rail, where the first metering pump and the second metering pump are fitted to the carriage for travel.

26. The painting machine according to claim 19, wherein the first metering pump and the second metering pump are integrated into the atomizer.

27. A painting machine, comprising:
an atomizer with a first paint inlet for a first paint system;
at least one additional second paint inlet for a second paint system;
an application device for applying both the paint systems;
a common inlet extending between the application device and each of the first paint inlet and the at least one additional second paint inlet;
a first main needle valve between the first paint inlet and the common inlet;
a second main needle valve between the at least one additional second paint inlet and the common inlet, each of the first paint inlet and the at least one additional second paint inlet being fluidly coupled to the application device through the first and second main needle valves, respectively, and the common inlet;
a first flushing pipe fluidly coupled to the common inlet for flushing the atomizer with a first flushing agent matched to the first paint system, and
a second flushing pipe fluidly coupled to the common inlet for flushing the atomizer with a second flushing agent matched to the second paint system, and
wherein at least one of the first and second flushing pipes is coupled to a section of pipe upstream of the first and second main needle valves,
wherein the first and second flushing pipes are each fluidly coupled to the common inlet downstream of the first paint inlet and the at least one additional second paint inlet, the first and second flushing pipes extending separately from each other in the atomizer and facilitating the introduction of different flushing agents for both paint systems,
wherein both the first and the at least one additional second paint inlets are separated from each other upstream of the common inlet, so that the atomizer may optionally apply one of the two different paint systems.

28. The painting machine according to claim 27, further comprising:
a first needle valve watchdog for monitoring the first main needle valve; and
an additional second needle valve watchdog for monitoring the second main needle valve.

29. The painting machine according to claim 27, further comprising:
a common main needle valve in the common inlet,
wherein the common main needle valve is fluidly connected to the application device through the common inlet and supplies the application device with one of the first and second paint system.

30. The painting machine according to claim 27, further comprising:
a first return pipe which diverges from the first paint inlet; and
a second return pipe which diverges from the second paint inlet, where the return pipes are separate from each other.

31. The painting machine according to claim 27, further comprising a third flushing pipe fluidly coupled to the common inlet downstream of the first paint inlet and the at least one additional second paint inlet for flushing the atomizer with a third flushing agent, which prevents a chemical reaction between the paint systems and between the matched flushing agents when the paint systems are changed.

32. The painting machine according to claim 27, further comprising:
a first supply line which supplies the first paint inlet of the atomizer with the first paint system, and
a second supply line which supplies the second paint inlet of the atomizer with the second paint system, where both supply lines are separate from each other.

33. The painting machine according to claim 32, further comprising:
a first colour changer, which feeds an interchangeable colour from the first paint system to the first supply line; and
a second colour changer, which feeds an interchangeable colour from the second paint system to the second supply line.

34. The painting machine according to claim 27, further comprising:
a first metering pump for metering the first paint system, and
a second metering pump for metering the second paint system.

35. The painting machine according to claim 34, wherein,
the first metering pump is located in the first supply line, and
the second metering pump is located in the second supply line.

36. The painting machine according to claim 34, wherein the painting machine is a painting robot, the painting machine further comprising:

a first robot arm, and a second robot arm which is articulated to the first robot arm and bears a robot wrist with the atomizer.

37. The painting machine according to claim 36, further comprising:

a first metering pump for metering the first paint system; and a second metering pump for metering the second paint system, wherein both of the metering pumps are located on the first robot arm.

38. The painting machine according to claim 36, further comprising:

a first metering pump for metering the first paint system; and a second metering pump for metering the second paint system, wherein both of the metering pumps are located on the second robot arm.

39. The painting machine according to claim 21, further comprising:

a first metering pump for metering the first paint system; and a second metering pump for metering the second paint system, wherein one of the two metering pumps is fitted to the first robot arm, while the other of the two metering pumps is fitted to the second robot arm.

* * * * *